US006533038B2

(12) United States Patent
Venning et al.

(10) Patent No.: US 6,533,038 B2
(45) Date of Patent: Mar. 18, 2003

(54) METHOD OF ACHIEVING A PREFERENTIAL FLOW DISTRIBUTION IN A HORIZONTAL WELL BORE

(76) Inventors: Laurie Venning, #102, 9622-42 Avenue, Edmonton, Alberta (CA), T8E 5T4; Trent Kaiser, Box 49036-RPO Strathcona, Edmonton, Alberta (CA), T6E 6H4

( * ) Notice: Subject to any disclaimer, the term of this patent is extended or adjusted under 35 U.S.C. 154(b) by 0 days.

(21) Appl. No.: 09/732,851

(22) Filed: Dec. 8, 2000

(65) Prior Publication Data

US 2002/0170717 A1 Nov. 21, 2002

(51) Int. Cl.[7] ..... E21B 43/12
(52) U.S. Cl. ..... 166/369; 166/50
(58) Field of Search ..... 166/50, 369, 305.1, 166/307; 405/44, 129.85, 129.7, 129.57, 184.2

(56) References Cited

U.S. PATENT DOCUMENTS

| | | | | | |
|---|---|---|---|---|---|
| 5,197,543 | A | * | 3/1993 | Coulter | 166/281 |
| 5,297,627 | A | * | 3/1994 | Sanchez et al. | 166/272.3 |
| 5,415,227 | A | * | 5/1995 | Jennings, Jr. | 166/236 |
| 5,421,410 | A | * | 6/1995 | Irani | 166/294 |
| 5,529,124 | A | * | 6/1996 | Hwan | 166/294 |
| 5,626,193 | A | * | 5/1997 | Nzekwu et al. | 166/303 |
| 5,931,230 | A | * | 8/1999 | Lesage et al. | 166/303 |
| 6,112,817 | A | * | 9/2000 | Voll et al. | 166/370 |
| 6,167,966 | B1 | * | 1/2001 | Ayasse et al. | 166/268 |
| 6,279,660 | B1 | * | 8/2001 | Hay | 166/336 |

OTHER PUBLICATIONS

Michael J. Landman; Analytic modelling of selectively perforated horizontal wells; 1994; Journal of Petroleum Science and Engineering, vol. 10; pp. 179–188.*

The Influence of Pressure Drop Along the Wellbore on Horizontal Well Productivity, E. Ozkan, C. Sarica, M. Haciislamoglu, R. Raghavan, The SPE Image Library, SPE 25502, Aug. 2, 1993, 20 pages.

Pressure Drop in Horizontal Wells and Its Effect on Production Performance, Ben J. Dikken, Society of Petroleum Engineers, JPT, Nov., 1990, p. 1426–1433.

Effects of Pressure Drop in Horizontal Wells and Optimum Well Length, V.R. Penmatcha, S. Arbabi, and K. Aziz, Society of Petroleum Engineers, SPE 37494, 1997, p. 801–813.

Inflow Performance of Partially Open Horizontal Wells, P.A. Goode, and D.J. Wilkinson, Society of Petroleum Engineers, JPT, Aug. 1991, p. 983–987.

Effect of Pressure Drop Along Horizontal Wellborse on Well Performance, A.N. Folefac, J.S. Archer, R.I. Issa, A.M. Arshad, The SPE Image Library, SPE 23094, Sep. 1991, 14 pages.

* cited by examiner

*Primary Examiner*—David Bagnell
*Assistant Examiner*—T. Shane Bomar
(74) *Attorney, Agent, or Firm*—Davis & Bujold, P.L.L.C.

(57) ABSTRACT

A method of achieving a preferential flow distribution in a horizontal well bore. This method consists of the step of positioning in a horizontal wellbore a slotted liner having a plurality of slots which provide a flow area. The slot open flow area of the slotted liner varying along its length in accordance with a selected strategy of flow distribution. The preferred strategy being to create an overbalanced condition in the wellbore which promotes promote a higher flow at the toe portion than at the heel portion.

11 Claims, 7 Drawing Sheets

Fig. 2 GRAPH 1 Inflow performance of slotted liner

Fig. 3 GRAPH 2 Pressure and slotting distributions for uniform inflow

Fig. 4 GRAPH 3 Over-balance well design and production profile

Fig. 5 GRAPH 4 Back-calculation of inflow. Optimized vs. non-optimized

Fig. 6 GRAPH 5 Slot density distribution for three design options

| Design Option | Pressure at Heel (MPa) |
|---|---|
| Conventional | 1460 |
| Uniform Inflow | 1860 |
| Overbalanced | 2120 |

Fig. 7

METHOD OF ACHIEVING A PREFERENTIAL FLOW DISTRIBUTION IN A HORIZONTAL WELL BORE

FIELD OF THE INVENTION

The present invention relates to a method of achieving a preferential flow distribution in a horizontal well bore.

BACKGROUND OF THE INVENTION

The pressure drop along a producing section of well bore has become the subject of study as the technology has been developed to drill horizontal well bores several kilometres long. In an article published in 1990 through the Society of Petroleum Engineers Ben J. Dikken presented an analytic model to predict the frictional pressure drop in a horizontal well due to turbulent well bore flow. In an article published in 1994 in the *Petroleum Science & Engineering Journal*, Michael J. Landman discussed how productivity of a well can be optimized by varying the perforation distribution along the well. An optimization strategy was proposed in which the perforations were arranged to provide for a uniform specific inflow along the horizontal well bore. Although it was acknowledged that the strategy would result in a slight loss if total well rate, this was justified on the basis that an advantage would be gained in delaying local cresting of water or gas into the well bore from a nearby aquifer or gas cap. The Landman article predicted that as a greater understanding was gained that other selective perforation strategies would be developed.

SUMMARY OF THE INVENTION

The present invention relates to a method of achieving a preferential flow distribution in a horizontal well bore.

According to the present invention, there is provided a method of achieving a preferential flow distribution in a horizontal well bore. This method consists of the step of positioning in a horizontal well bore a slotted liner having a plurality of slots which provide a flow area. The slot open flow area of the slotted liner varying along its length in accordance with a selected strategy of flow distribution.

The teachings of Landman related specifically to perforations. In contrast, the present invention relates to slotted liners used to reduce the inflow of sand into the well bore. This method of flow control has an advantage over the teachings of Landman Using the slotted liner for flow distribution is closer to the point of production and has fewer "dead" zones.

Although beneficial results may be obtained through the application of the method, as described above, even more beneficial results may be obtained when the slot open flow area of the slotted liner increases from the heel portion to the toe portion to create an overbalanced condition designed to promote higher flow at the toe than at the heel. This is in accordance with a flow distribution strategy intended to restrict water coning and gas break through tendencies to the toe portion of the well bore where they can be more readily mitigated. For injection wells, the strategy of creating an overbalanced condition is intended to reduce the tendency for short circuiting.

Landman described an unequal flow distribution that occurs in a horizontal well due to such factors as frictional pressure drop and turbulent flow described by Dikken Landman sought to optimize the flow distribution, by making the flow distribution equal along the horizontal well bore.

Unlike the strategy advocated by Landman, the strategy described abrade does not seek a uniform inflow or outflow pattern. Instead, an unequal flow distribution is deliberately created. This method has an inherent disadvantage in that higher pressure draw down is required to promote the desired inflow distribution. This means the method is best suited to lighter oil reservoirs with good pressure drive. It is believed that this disadvantage is more than offset by the advantages. Firstly, there is a reduced volume of produced water, with the associated treatment and disposal costs. Secondly, increased reserves are realized from increased cumulative production. This combination of increased recovery and decreased costs will increase the economic life of the well.

Water coning or gas break through inevitably occurs. However, in accordance with the teachings of the present method water coning or gas break through problems can be dealt with. Following the teachings of the method ensures that water coning or gas break through occurs at the toe portion of the well bore. When such water coning occurs a further step is taken of positioning a plug in the toe portion of the well bore in order to isolate the toe portion and permits oil to continue to be produced from that portion of the well bore not experiencing such water coning or gas break through.

Eventually water coning or gas break through will reoccur. Following the teachings of the method ensures that the reoccurrence of water coning or gas break through will be at the remote end of the well bore just ahead of the plug. This can be dealt with by repositioning the plug in the well bore in order to isolate the water producing zone and permit oil to continue to be produced from that portion of the well bore not experiencing water coning or gas break through. In this manner the shut down of the well due to water coning or gas break through can be delayed for years, by merely plugging off the remote end of the well bore.

BRIEF DESCRIPTION OF THE DRAWINGS

These and other features of the invention will become more apparent from the following description in which reference is made to the appended drawings, wherein:

FIG. 7 is a table showing pressure draw-downs required for the same production rate from the three designs.

DETAILED DESCRIPTION OF THE PREFERRED EMBODIMENT

The preferred method of achieving a preferential flow distribution in a horizontal well bore will now be described with reference to FIG. 1.

Figure 1:
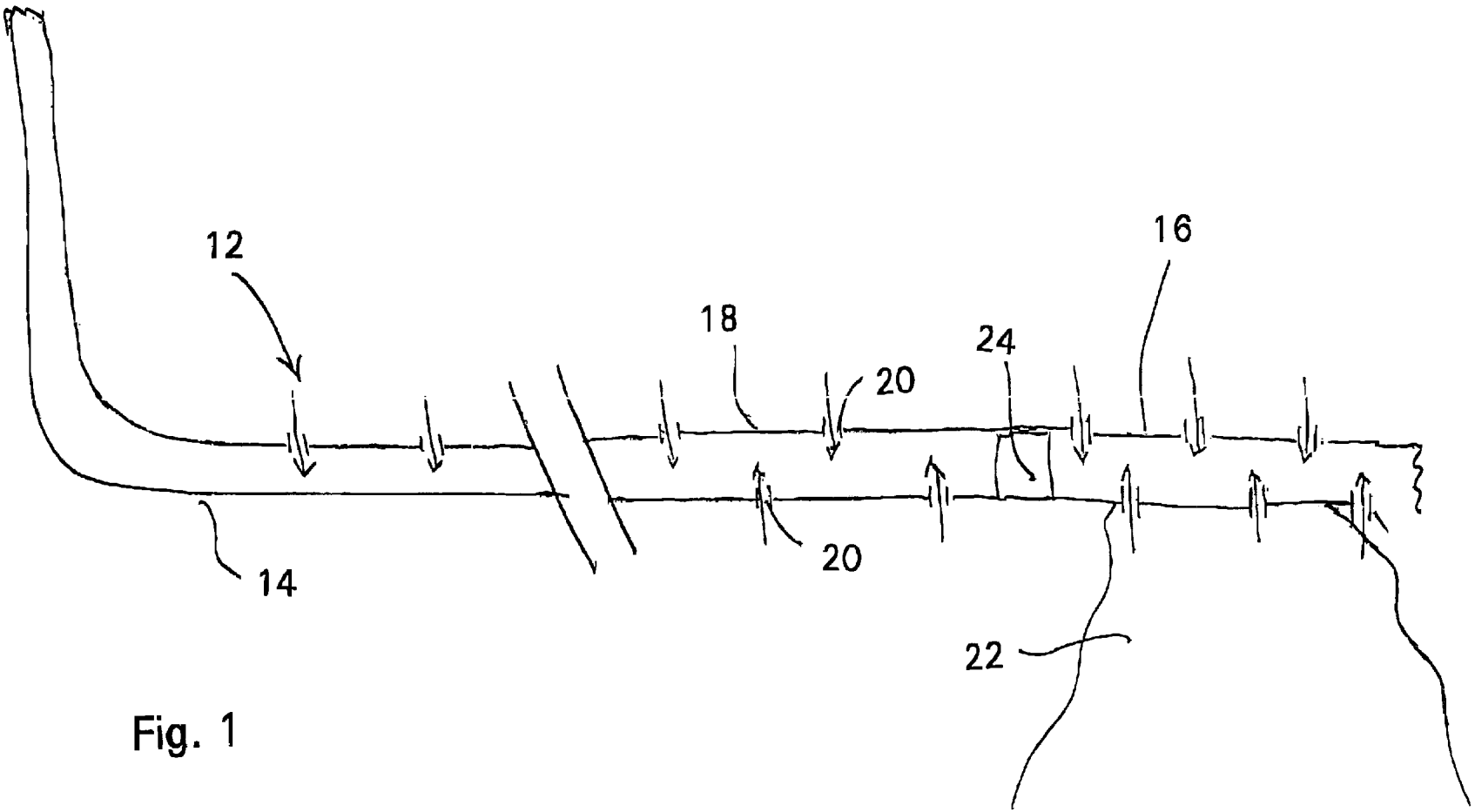
FIG. 1 is a side elevation view of a well bore having a slotted liner in accordance with the teachings of this present method.

Referring to FIG. 1, there is illustrated a horizontal well bore 12 having a heel portion 14 and a toe portion 16. The preferred method includes a first step of positioning in horizontal well bore 12 a slotted liner 18 having a plurality of slots 20 which provide a flow area. As will hereinafter be further described, the slot open flow area of slotted liner 18 varies along its length. The slot open flow area of slotted liner 18 increases from heel portion 14 to toe portion 16. This is done to create an overbalanced condition designed to promote higher inflow at toe portion 16 than at heel portion 14. The slot open flow area of slotted liner 18 in heel portion 14 of well bore 12 is less than 0.4% of the area of slotted liner 18 as compared to a slot open flow area that is many times that amount at the toe This creates a slot induced radial flow loss at the heel This is in accordance with a flow distribution strategy intended to restrict water coning and gas break through tendencies to toe portion 16 of well bore 12 where water coning can be more readily mitigated. The slot open flow area at toe portion 16 will vary with the length of the well bore and the reservoir characteristics. As a general rule the slot open flow area at toe portion 16 will be a multiple of the slot open flow area at heel portion 14. This multiple can be as little as twice the slot open flow area or can be more than one hundred times the slot open flow area. In the examples that are hereinafter given and graphically supported, the multiple is close to one hundred times the slot open flow area.

The preferred method involves a second step which is taken when water coning or gas break through occurs. Referring to FIG. 1, there is shown a water cone 22 that is resulting in an inflow of an unacceptable amount of produced water into well bore 12. The second step is to position a plug 24 in toe portion 16 of well bore 12 when water coning or gas break through occurs. This isolates toe portion 16 and permits oil to continue to be produced from the remainder of the well bore that is not yet experiencing water coning or gas break through If water coning or gas break through subsequently occurs ahead of plug 24, plug 24 is moved along well bore 12 to maintain isolation of the water producing portion of well bore 12. Of course, unslotted pipe is used along portions of well bore 12 passing through water zones.

It will be appreciated that the advantages gained from an overbalanced condition are equally applicable to injection wells. For example, where steam is injected to stimulate an oil reservoir; a portion of the steam often short circuits from the heel portion of the well. The above described overbalanced condition reduces the extent of such short circuiting.

Following is a sample programmed well bore design along with a comparison with conventional well performance.

1 Well Bore Design for Uniform Draw Down

An assumption of uniform inflow over the well length is made which, therefore, defines the flow velocity profile for the well. The pressure distribution can, therefore, be calculated using pipe flow loss correlations. Such correlations are available for any flow regime of interest, including laminar/turbulent flow, and single/multi-phase flow. Single phase flow is assumed in this example, and the example parameters produce turbulent flow throughout most of the well. The parameters assumed are:

Producing interval: 1000 m

Fluid viscosity: 1 centipoise

Formation permeability: a Darcy (isotropic conditions)

Liner size: 114.3 mm OD (5.5 inch)

Total Production: $100^3$/day

A slot geometry is selected to provide the sand control required for the reservoir. For this example the geometry chosen is 0.15 mm wide by 54 mm long (0.06 inch by 2.125 inch).

Figure 2:
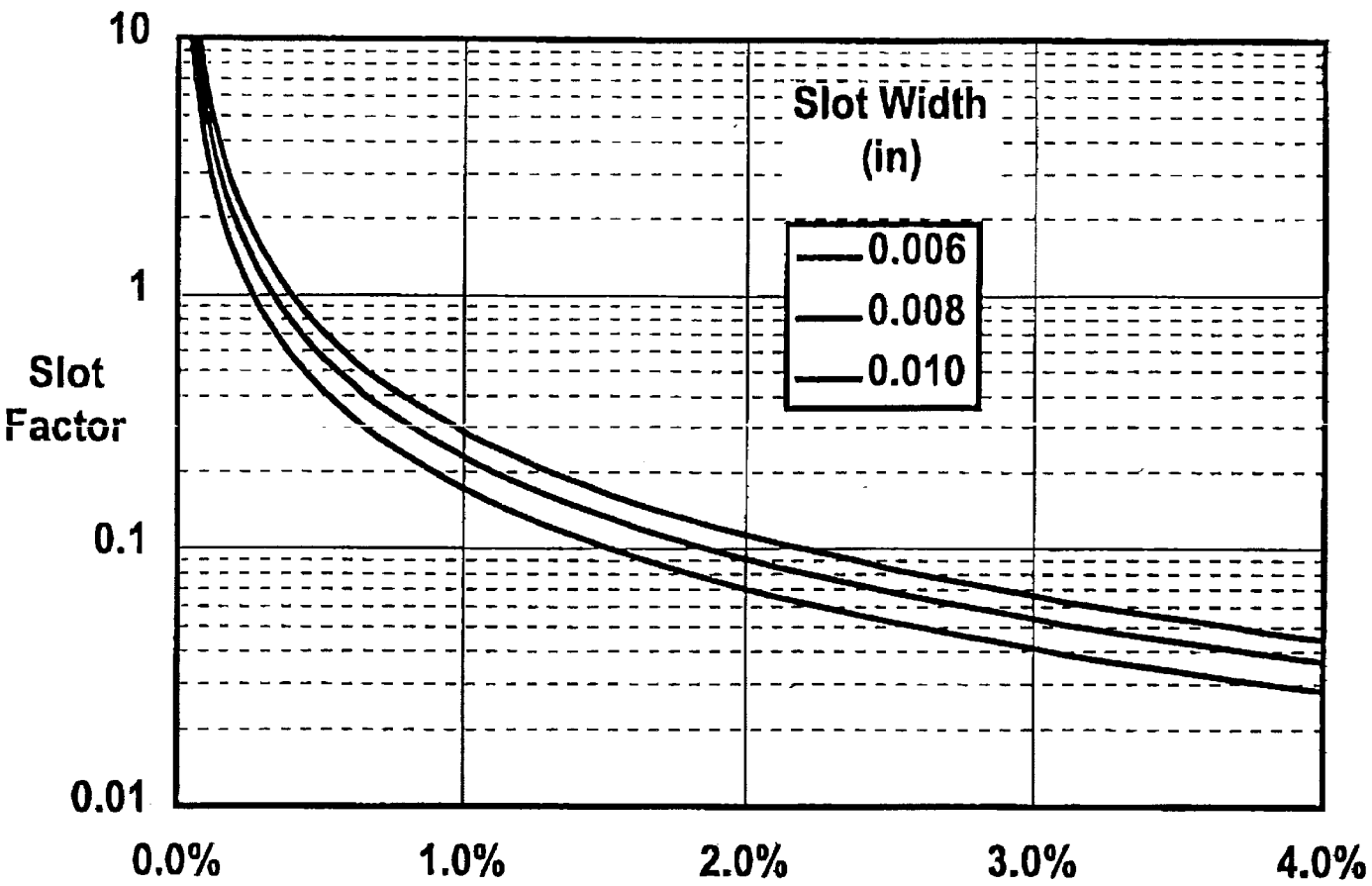
FIG. 2 is Graph 1 showing the inflow performance off a slotted liner.

Inflow performance for slots has been determined using finite element models of formation flow into slots, assuming a sand pack around the liner with the same permeability as the liner. While conventional designs assume open area controls inflow performance of liners, analysis demonstrates that slot spacing is the strongest controlling factor. FIG. 2 (Graph 1) demonstrates this relationship by showing the inflow performance for the chosen slot geometry along with curves for wider slots, The performance is given by a slot skin factor, which is the contribution to the overall skin factor associated with flow convergence to the slot. The results demonstrate that the closer slot spacing required for more, thinner slots reduces the flow loss for a given open area.

Figure 3:
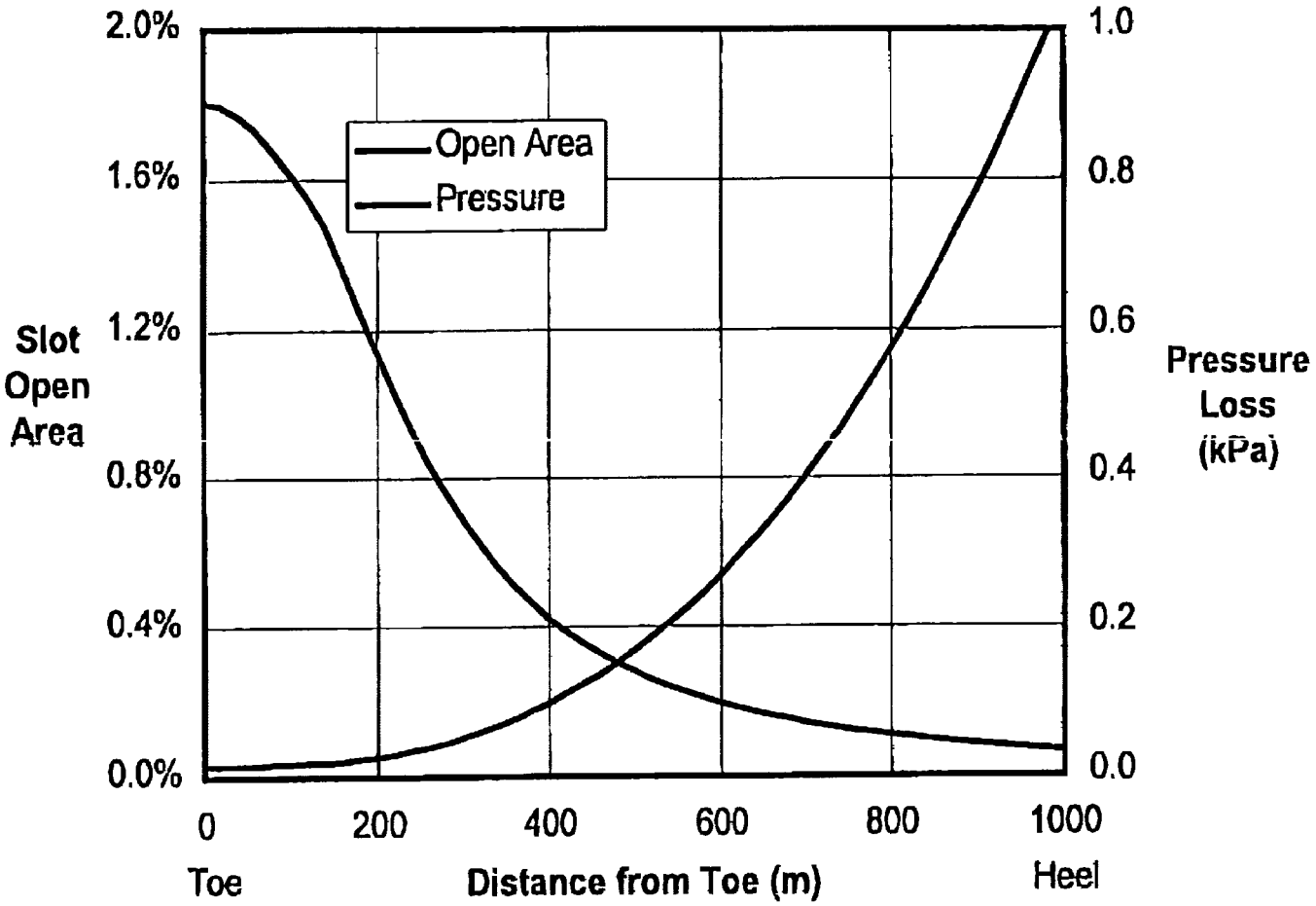
FIG. 3 is Graph 2 showing pressure and slotting distributions for uniform inflow.

Matching the flow loss associated with the slot factor to the pressure draw down inside the liner yields the slot distribution required for the specified production distribution. In this example, uniform production is specified. FIG. 3 (Graph 2) shows the pressure and slotted area distributions that are calculated by this method to produce uniform inflow.

FIG. 3 (Graph 2) shows the inflow pressure loss varying from 0.02 kPa at the toe to about 1 kPa at the heel. The change in pressure (2.2 kPa) is due to frictional losses from pipe flow. The slot density distribution is used to balance the slot-induced radial flow loss to match the pipe flow loss over the entire producing interval. Note, however, that this slot-induced flow loss develops in the near-well-bore region of the reservoir. Beyond that interval, the reservoir is subjected to a nearly uniform draw clown over its length.

Figure 4:
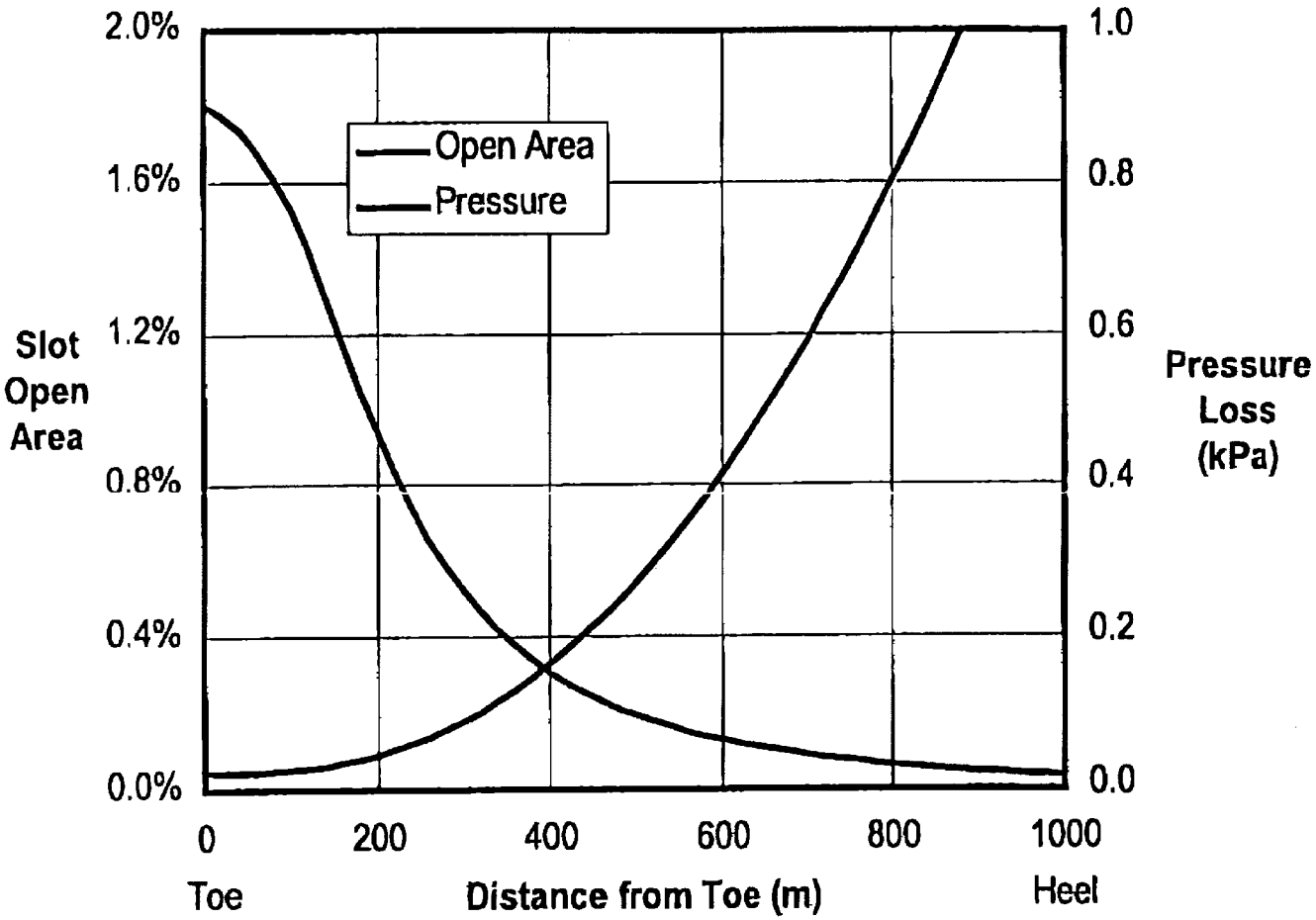
FIG. 4 is Graph 3 showing overbalance well design and production profile.
Figure 5:
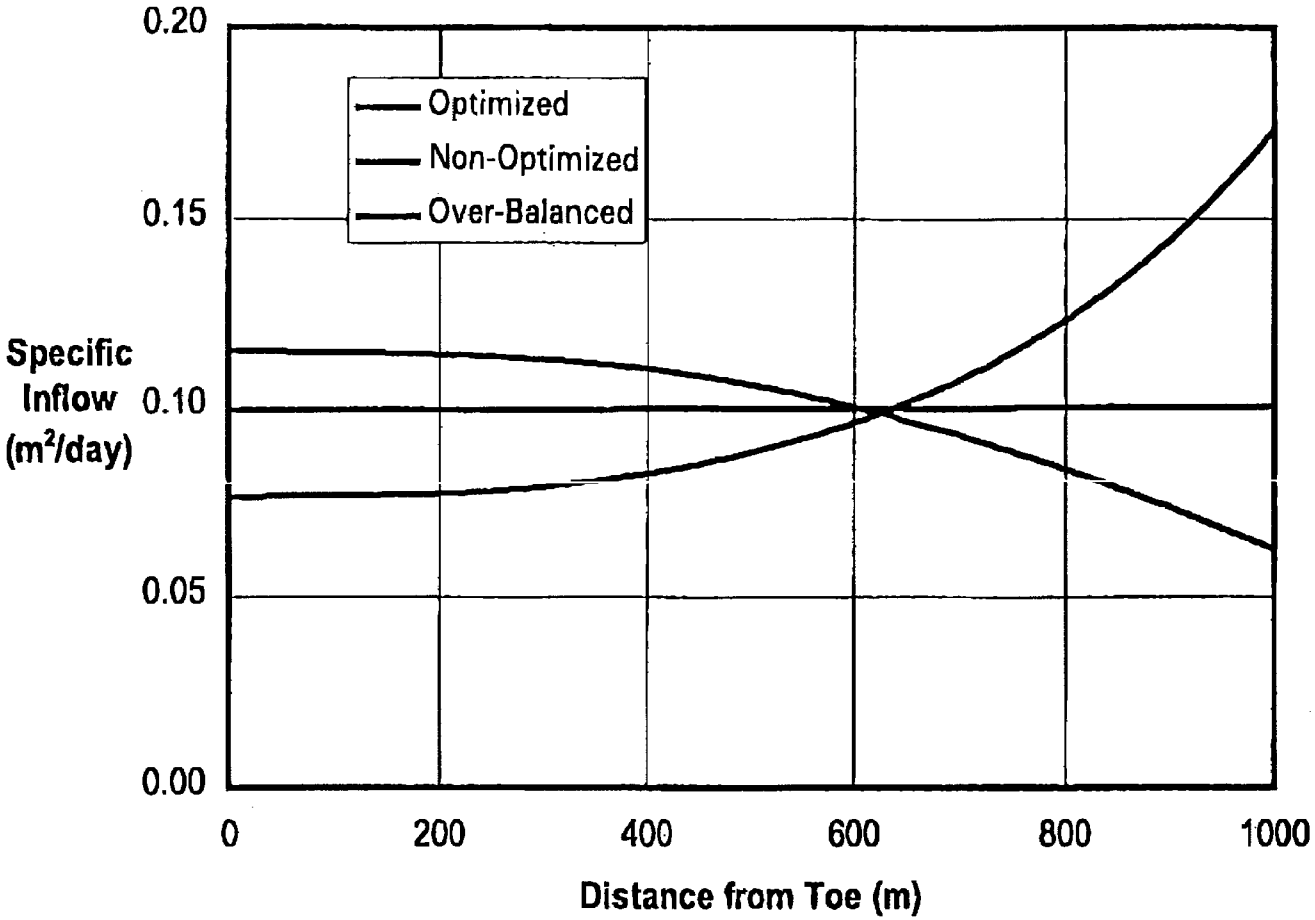
FIG. 5 is Graph 4 showing back-calculation of inform: optimized vs. non-optimized.

An overbalanced condition can be designed to promote higher inflow at the toe than at the heel. The pressure and slotting distributions calculated for an inflow distribution giving approximately twice as much inflow at the toe than at the heel is given in FIG. 4 (Graph 3). Boundary conditions are applied to give the same slot density at the toe and a new slot distribution is calculated over the rest of the well. Note the higher pressure draw down near the heel required to promote the flow at the heel While laminar flow regimes give solutions covering the entire laminar flow range, nonlinear pipe-flow regimes make the optimized design configuration sensitive to production rates. A back-calculation module can be used to determine the sensitivity. It also gives a demonstration of the effectiveness of the design method FIG. 5 (Graph 4) shows inflow distributions for the same well, comparing optimized, non-optimized and overbalanced designs for the same production rate of 100 $m^3$/day. The non-optimized design uses the same slot density over the entire well, using the slot density calculated at the toe of the optimized design. The programmed wellbore produces uniform production over the entire well, whereas the conventional design produces 2.25 times as much at the heel as at the toe. This would clearly generate higher far-field pressure gradients that aggravate water coning tendencies at the heel. The overbalanced design generates about twice as much specific inflow at the toe as at the heel, generating higher water coning tendency at the toe, which is much easier to mitigate.

Figure 6:
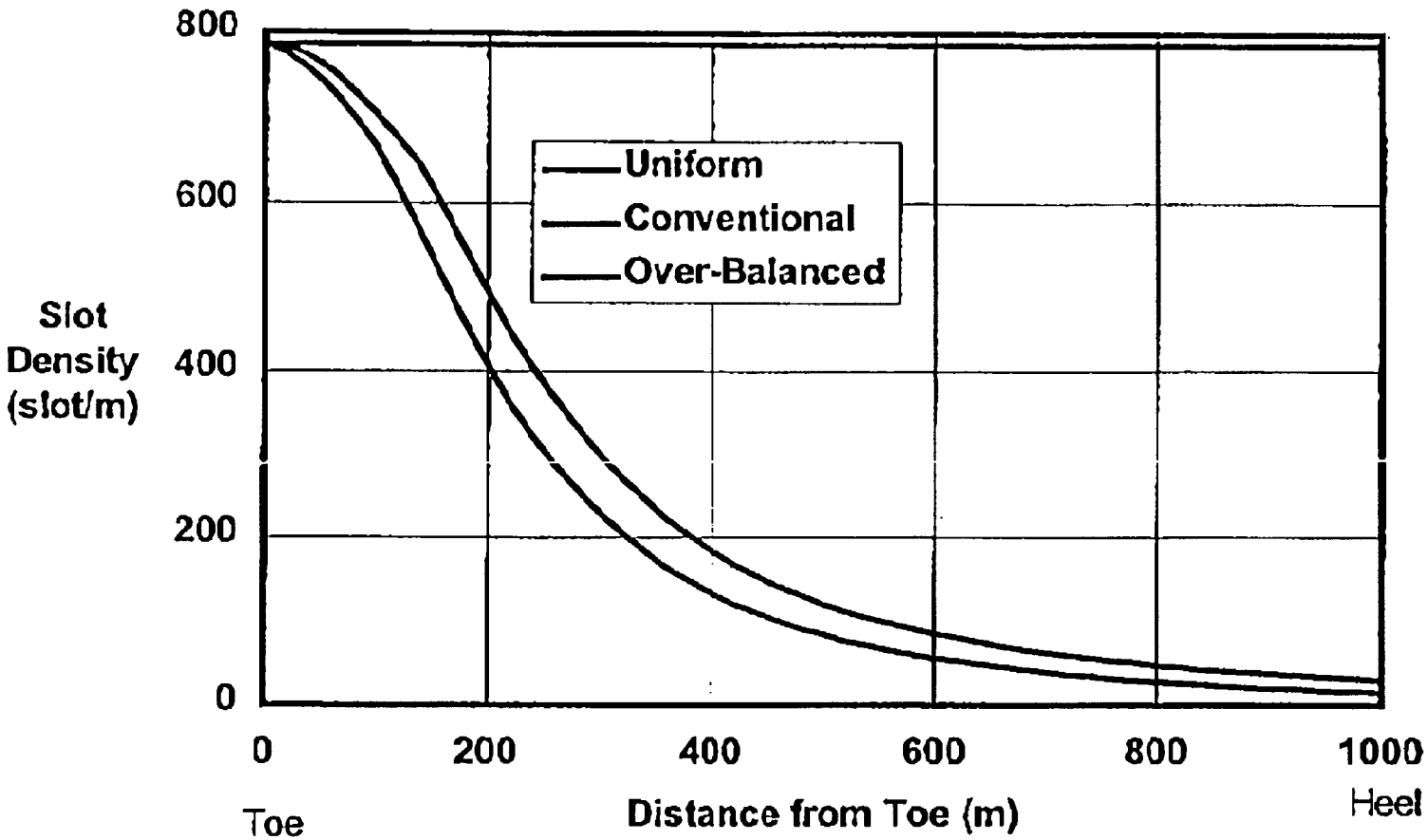
FIG. 6 is Graph 5 showing a slot density distribution for three design options.

A comparison of slot density distribution for the three design options is given in FIG. 6 (Graph 5). FIG. 7 is a table of pressure draw downs required for the same production rate from the three designs.

2 Summary

The programmed wellbore use slot density to control the inflow resistance to balance the pipe flow resistance and promote uniform inflow distributions. This provides a more cost-effective caption for uniform flow distribution than drilling larger wells installing larger liners because of the savings in drilling, steel and slotting costs. It also offers the option of overbalancing the flow distribution to promote greater inflow or outflow toward the toe.

It will be apparent to one skilled in the art that modifications may be made to the illustrated embodiment without departing from the spirit and scope of the invention as hereinafter defined in the claims.

The embodiments of the invention in which an exclusive property or privilege is claimed are defined as follows:

1. A method of achieving a preferential flow distribution in a horizontal wellbore, comprising the step of:

positioning in a horizontal wellbore, having a heel portion to a remote toe portion, a slotted liner having a plurality of slots which provide a slot open flow area, the slot open flow area being the product of slot geometry selected to provide sand control and slot density, the slot open flow area of the slotted liner varying along its length in accordance with a selected strategy of flow distribution, the slot open flow area of the slotted liner in the heel portion of the wellbore being less than 0.4% of the area of the slotted liner in order to create a slot induced radial flow loss.

2. The method as defined in claim 1, the slot open flow area of the slotted liner increasing from the heel portion to the toe portion to create an overbalanced condition designed to promote higher flow at the toe portion than at the heel portion.

3. The method as defined in claim 2, the slot open flow area at the toe portion being at least twice the slot open flow area at the heel portion.

4. The method as defined in claim 2, a plug being set in the toe portion of the wellbore when one of water coning or gas break through occurs in order that oil may continue to be produced by that portion of the wellbore not experiencing such water coning or gas break through.

5. The method as defined in claim 1, the slot open flow area being reduced along portions of the wellbore passing through water zones.

6. A method of achieving a preferential flow distribution in a horizontal wellbore, comprising the step of:

positioning in a horizontal wellbore, having a heel portion to a remote toe portion, a slotted liner having a plurality of slots which provide a slot open flow area, the slot open flow area being the product of slot geometry selected to provide sand control and slot density, the slot open flow area of the slotted liner varying along its length, the slot open flow area of the slotted liner in the heel portion of the wellbore being less than 0.4% of the area of the slotted liner in order to create a slot induced radial flow loss, the slot open flow area of the slotted liner increasing from the heel portion to the toe portion to create an overbalanced condition designed to promote higher flow at the toe portion than at the heel portion.

7. The method as defined in claim 6, the slot open flow area at the toe portion being more than twice the slot open flow area at the heel portion.

8. The method as defined in claim 6, the slot open flow area being reduced along portions of the wellbore passing through water zones.

9. The method as defined in claim 6, a plug being set in the toe portion of the wellbore when one of water coning or gas break through occurs in order that oil may continue to be produced by that portion of the wellbore not experiencing such water coning or gas break through.

10. A method of achieving a preferential flow distribution in a horizontal wellbore, comprising the steps of:

positioning in a horizontal wellbore, having a heel portion to a remote toe portion, a slotted liner having a plurality of slots which provide a slot open flow area, the slot open flow area being the product of slot geometry selected to provide sand control and slot density, the slot open flow area of the slotted liner varying along its length, the slot open flow area of the slotted liner in the heel portion of the wellbore being less than 0.4% of the area of the slotted liner in order to create a slot induced radial flow loss, the slot open flow area of the slotted liner increasing from the heel portion to the toe portion to create an overbalanced condition designed to promote higher inflow at the toe portion than at the heel portion in accordance with a flow distribution strategy intended to restrict water coning or gas break through tendencies to the toe portion of the wellbore where water coning can be more readily mitigated, the slot open flow area at the toe portion being more than twice the slot open flow area at the heel portion; and positioning a plug in the toe portion of the wellbore when one of water coning and gas break through occurs in order to isolate the toe portion and permit oil to continue to be produced from that portion of the wellbore not experiencing such water coning or gas break through.

11. The method as defined in claim 10, the slot open flow area being reduced along portions of the wellbore passing through water zones.

* * * * *